US006530799B2

(12) United States Patent
Regnier et al.

(10) Patent No.: US 6,530,799 B2
(45) Date of Patent: Mar. 11, 2003

(54) PLUG CONNECTOR HAVING A SECONDARY LOCKING DEVICE

(75) Inventors: Vincent Regnier, Nuremberg (DE); Michael Gunreben, Feucht (DE)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 10/004,400

(22) Filed: Nov. 15, 2001

(65) Prior Publication Data

US 2002/0081888 A1 Jun. 27, 2002

(30) Foreign Application Priority Data

Nov. 17, 2000 (DE) ..... 100 57 001
Oct. 22, 2001 (DE) ..... 101 51 956

(51) Int. Cl.[7] ..... H01R 13/627
(52) U.S. Cl. ..... 439/352; 439/489
(58) Field of Search ..... 439/352, 489, 439/488, 188, 350, 357, 358, 353

(56) References Cited

U.S. PATENT DOCUMENTS 5,591,041 A * 1/1997 Cecil, Jr. et al. ..... 439/352
5,863,214 A * 1/1999 Hanak ..... 439/352
6,328,589 B1 * 12/2001 Annecke ..... 439/352
6,341,972 B1 * 1/2002 Odorfer ..... 439/352

FOREIGN PATENT DOCUMENTS

| | | |
|---|---|---|
| DE | 19728448 C1 | 9/1998 |
| EP | 0791987 A2 | 8/1997 |
| EP | 1006621 A2 | 6/2000 |
| WO | WO 97/41623 | 11/1997 |

* cited by examiner

*Primary Examiner*—P. Austin Bradley
*Assistant Examiner*—Ross Gushi
(74) *Attorney, Agent, or Firm*—Perman & Green, LLP

(57) ABSTRACT

A plug connector (1) is disclosed having a secondary locking device (8) with legs (10), which fix the locking arms (5) of the plug connector (1) in their final locked position in a socket (16). The secondary locking device (8) also has a spring arm (12) with a step (13), which is supported on a locking projection (15) formed on the housing (2) of the plug connector (1), which holds the secondary locking device (8) in a pre-locked position, where the step (13) is only lifted from the locking projection (15) during the insertion of the plug connector (1) into the socket (16). Thereafter, the secondary locking device (8) can be locked into the final locked position.

18 Claims, 4 Drawing Sheets

PLUG CONNECTOR HAVING A SECONDARY LOCKING DEVICE

BACKGROUND OF THE INVENTION

1. Field of the Invention

The present invention relates to a plug connector having a secondary locking device, and more particulary, to a plug connector having a secondary locking device which includes at least one leg, where the at least one leg fixes a locking arm of the plug connector in a final locked position in a socket, where at least one of the legs includes a locking arm with a step which is supported on a locking projection formed on a housing of the plug connector and which holds the secondary locking device in a pre-locked position, and further where the secondary locking device can be locked into the final locked position.

2. Description of Prior Developments

A plug connector typical of known plug connectors is illustrated in EP 1 006 621 A2. Plug connectors of this type find particular application as airbag restraint systems in automotive vehicles and are used for the connection of these airbag restraint systems to an ignition base. The ignition bases are located on, for example, the collapsible ring of the steering wheel or elsewhere, where the flat construction of the plug connector is important for reasons of space. It is a further essential requirement placed on such plug connectors that the insertion connection between the plug connector and the socket should not in any circumstances become loosened. It is the function of the secondary locking device to ensure that a plug and a socket shall not become loosened unintentionally.

Both EP-A-0 632 534 and WO 97/41623 describe a plug connector of a flat construction for connection to the ignition base of an airbag, where a secondary locking device prevents the loosening of the plug connector from the ignition base. The secondary locking devices can be unintentionally placed into the final locked position before the connector "halves" are joined to one another, which prevents assembly.

A plug connector with a secondary locking device is also known from DE-C-197 28 448, where the secondary locking device is secured on the plug connector with locking legs, in order to prevent possible detachment. By means of introducing the secondary locking device into the appropriate socket, the locking legs prevent the locking arms of the plug connector from becoming loosened from the final locked position. If the secondary locking device of such a plug connector is placed in the pre-locked position, it can nevertheless happen that during transport or handling of the first connector parts, the secondary locking device becomes loosened from its pre-locked position and pressed into its final locked position, before the introduction of the plug connector into the socket has taken place. Through the locking legs which have been inserted, it is no longer possible to introduce the plug connector into the socket, i.e. into the ignition device, since the locking legs with their locking projections are wider than the slots into which they are to be inserted. Consequently, a device is needed to be able to loosen the secondary locking device manually.

EP 1 006 621 A2 describes a plug connector with a secondary locking device, wherein the secondary locking device can only be pressed into its final position through a part of the socket with an opening of a tong-shaped spring arm arrangement. Owing to the fact that the secondary locking device and the spring arms lie on different levels with respect to the longitudinal axis of the plug connector, the locking clamp can tilt both during the assembly of the locking clamp on a connector part and during the introduction of the plug connector into the socket, which can adversely affect the assembly of the plug connector parts.

SUMMARY OF THE INVENTION

It is an objective of the present invention to develop a plug connector as described above in such a way that the unintentional pressing of the secondary locking device into its final locked position is impossible before the two plug connector "halves" have been joined together, without adversely affecting the joining process itself.

Thus, in accordance with the features of the present invention there is described a plug connector having a secondary locking device which includes at least one leg, where the at least one leg fixes a locking arm of the plug connector in a final locked position in a socket, where at least one of the legs includes a locking arm with a step which is supported on a locking projection formed on a housing of the plug connector and which holds the secondary locking device in a pre-locked position. Further wherein the secondary locking device can be locked into the final locked position. The invention is characterized by the secondary locking device including two spring arms, each of the arms having a step and a projection which are arranged symmetrically to a longitudinal axis of the plug connector, whereby during the process of insertion of the plug connector into the socket, the spring arms are deflected by the locking projections so that the step of the spring arms is lifted from the locking projections and the secondary locking device is thereby released.

In one preferred embodiment of the present invention, the spring arm has on its insertion end a projection, through which during the insertion of the plug connector into the socket, the spring arm is deflected in such a way that the step of the spring arm is lifted from the locking projection and the secondary locking device is released. By means of this form of the spring arm, the latter is bent during the process of insertion of the plug connector into its socket when the projection reaches the socket, whereby the step is loosened from the locking projection. Preferably, the locking projection is wedge-shaped where, during the introduction of the plug connector into its socket, the wedge-shaped section reaches a face of the socket opposite the plug connector. As the introduction of the plug connector into its socket proceeds, the spring arm is introduced into an opening of the socket, which may, for example, be the opening into which the insertion face of the plug connector is inserted.

In another preferred embodiment of the present invention, the free ends of the legs are supported on the free end of the locking arms during the introduction of the secondary locking device into the plug connector, whereby the introduction of the secondary locking device into the final locked position is prevented, until the locking arms snap into the recesses provided for the locking of the plug connector into its socket, whereby the locking arms vacate the insertion path of the legs and the secondary locking device becomes lockable into the final locked position. This invention-related geometry also prevents the secondary locking device from being able to be placed in its final locked position. Only when the locking shoulders of the locking arms are locked into the recesses provided for that purpose in the socket, are the pre-tensioned locking arms pressed outwards and only then an insertion of the secondary locking device becomes possible. This leads to two conditions for the insertion of the secondary locking device into its final locked position.

Firstly, the shoulder of the spring arm must be lifted from the locking projection formed on the housing of the plug connector and secondly, the plug connector must have become finally locked into the socket, until an insertion of the secondary locking device becomes possible. This makes it easy for the operative to ascertain from the outside, whether the plug connector and the socket are correctly joined. If the secondary locking device can be brought into its final locked position, then the joining of the plug connector and its socket has been successful.

In still another preferred embodiment of the present invention, the locking arms are formed on an insertion face on the underside of the housing, whereby the free ends of the locking arms are bent against the direction of insertion. In this way, it is possible for the rear face of the locking arms is able to reach the lower end of the leg, whereby the insertion of the secondary locking device is prevented until the locking arms have vacated the insertion path by swinging outwards, when a complete joining of the two plug connector portions has taken place.

BRIEF DESCRIPTION OF THE DRAWINGS

The accompanying drawings, which are incorporated in and constitute a part of the specification illustrate specific embodiments of the invention and, together with the description hereinbelow serve to explain the principles of the invention.

DESCRIPTION OF THE PREFERRED EMBODIMENTS

While the present invention will be described hereinafter in connection with preferred embodiments thereof, it should be understood that it is not intended to limit the invention to these embodiments. On the contrary, it is intended to cover all alternative, modifications and equivalents as may be included within the spirit and scope of the invention as defined by the appended claims.

Figure 1:
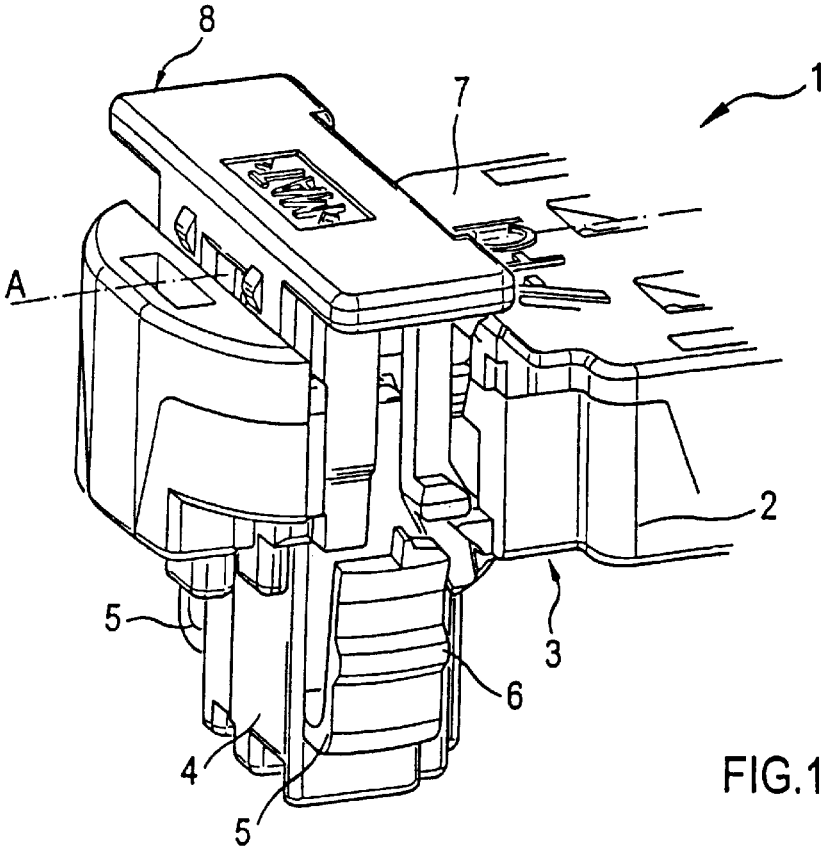
FIG. 1 is a diagonal view of the plug connector with a secondary locking device in its pre-locked position, in a preferred embodiment.

FIG. 1 is a perspective view of the plug connector 1 with a housing 2, which has on the housing side 3 an insertion face 4, on whose opposite ends are formed locking arms 5. The locking arms 5 have locking shoulders 6, which snap into recesses, which are provided for that purpose, during the introduction of the plug connector 1 into a socket (not shown). A secondary locking device 8 can be inserted into the upper face 7.

Figure 2:
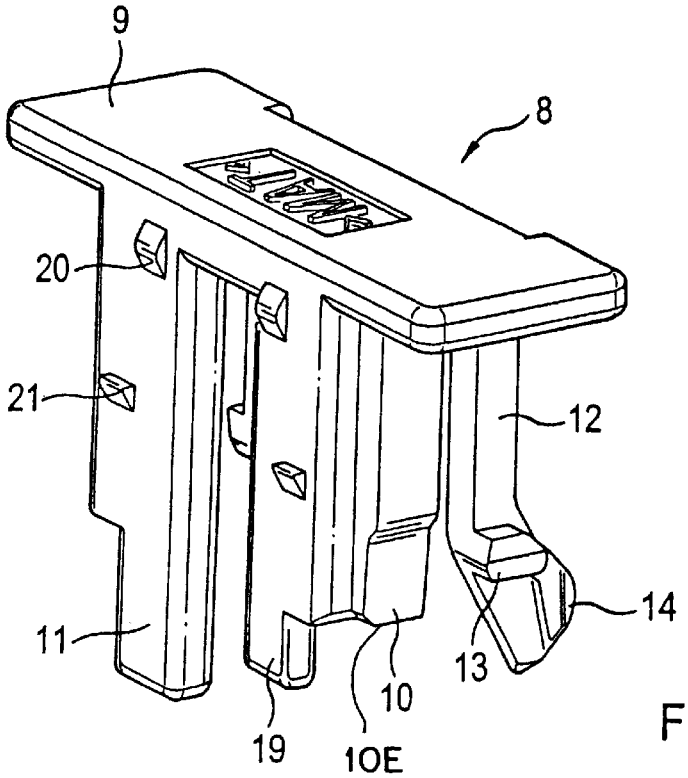
FIG. 2 is a perspective view of the secondary locking device.

As can be seen in FIG. 2, the said secondary locking device has a horizontal plate 9 on whose underside extend a leg 10 (locking leg) and a second leg 11 and a spring arm 12. The spring arm 12 has a step 13 and a projection 14, where the projection is wedge-shaped and is located on the insertion side of the spring arm. The secondary locking device is inserted through openings, provided for that purpose, from the upper face 7 of the plug connector 1 into the latter. The secondary locking device 8 also has locking shoulders 20, 21, by means of which the secondary locking device 8 can be locked into the pre-locked or final locked position in the housing 2 of the plug connector. In the embodiment shown, the leg 10 and the spring arm 12 are separate (for example purposes), but can nevertheless still be combined in a single leg, which then assumes the functions of both a plug and a spring.

Figure 3:
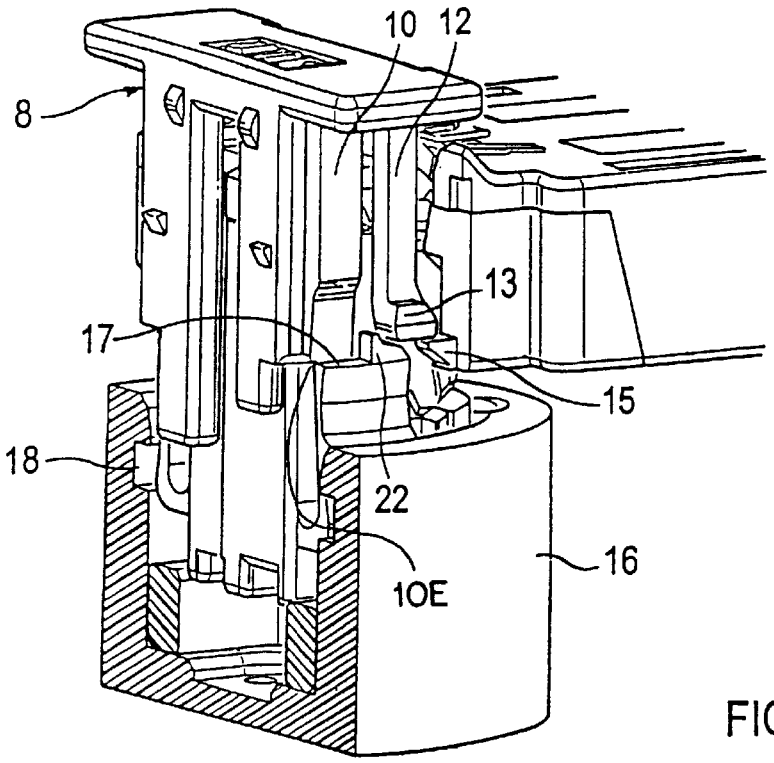
FIG. 3 is the plug connector during the process of its introduction into the socket.

As shown in FIG. 3, the step 13 formed at right angles to the direction of insertion, reaches during the insertion of the secondary locking device 8, reaches the locking projection 15 formed on the plug connector housing 2. Preferably, a further locking projection 15 which supports a further step 13 of the second spring arm 12 of the secondary locking device, is located in an axially symmetrical manner to the symmetry axis A of the plug connector 1, on the opposite face which is not shown. During the insertion of the plug connector 1 into the socket 16, the spring arm 12 is deflected by locking projection 15 acting against step 13 so that the said spring arm 12 bends, whereby the step 13 is lifted from the locking projection 15. Through the insertion of the plug connector 1 into the socket 16, the locking arms are pressed together. The legs 10 of the secondary locking device 8 rest with their lower end 10E on a face 17, which is located vertically to the direction of insertion at the free ends of the locking arms 5. This supported position of the legs 10 on the locking arms 5, also prevents the insertion of the secondary locking device 8 into its final locked position. Through a wedge-shaped crest 22 projecting from locking arms 5, the step 13 also rests on the locking arm 5, until the latter swigs outwards. In this position, seen best in FIG. 3, the step 13 of the spring arm 12 is held between projection 15 on one side and crest 22 on the opposite side.

Figure 4:
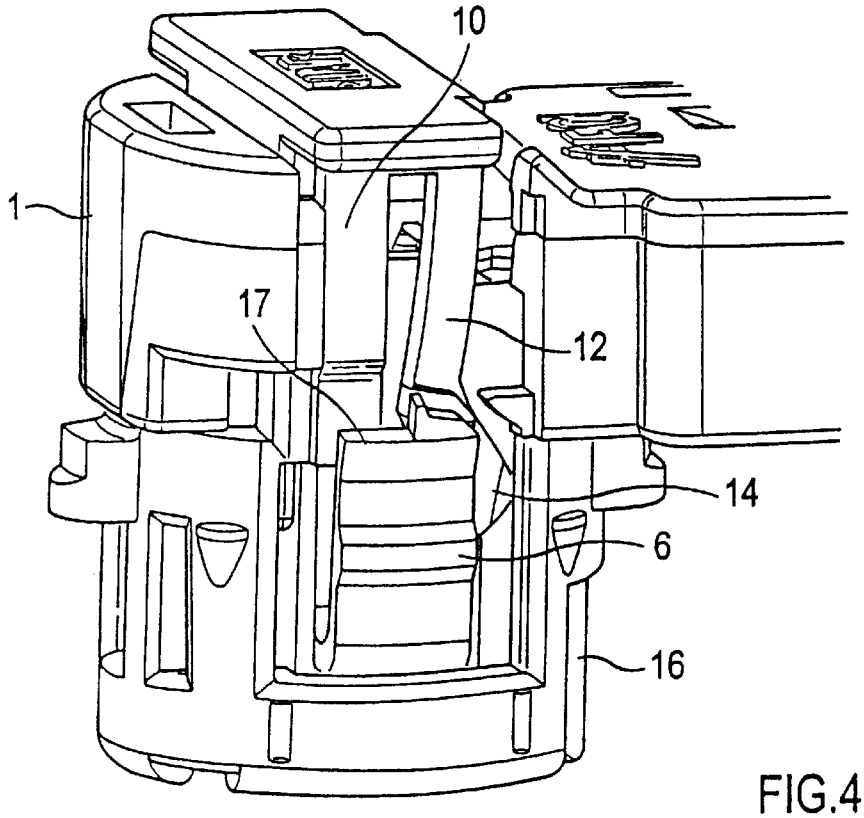
FIG. 4 is a lateral view after the joining of the plug connector and the socket with the secondary locking device almost fully inserted.

FIG. 4 shows the plug connector 1 and the socket 16 in a joined position. Through the complete insertion of the plug connector 1 into the socket 16, the locking shoulders 6 of the locking arms 5 are pressed into recesses 18 (see FIG. 3). The pre-tensioned locking arms move outwards, the legs 10 are no longer supported on the face 17, so that the secondary locking device 8 can be locked into its final locked position by means of the application of a force to the horizontal plate 9. After the insertion of the legs 10, the locking shoulders 6 are firmly ensconced in the recesses 18 and the loosening of the plug connector is no longer possible. As can be seen, the spring arm 12 is bent, since the projection 14 through being supported on the socket 16, bends the spring arm 12.

Figure 5:
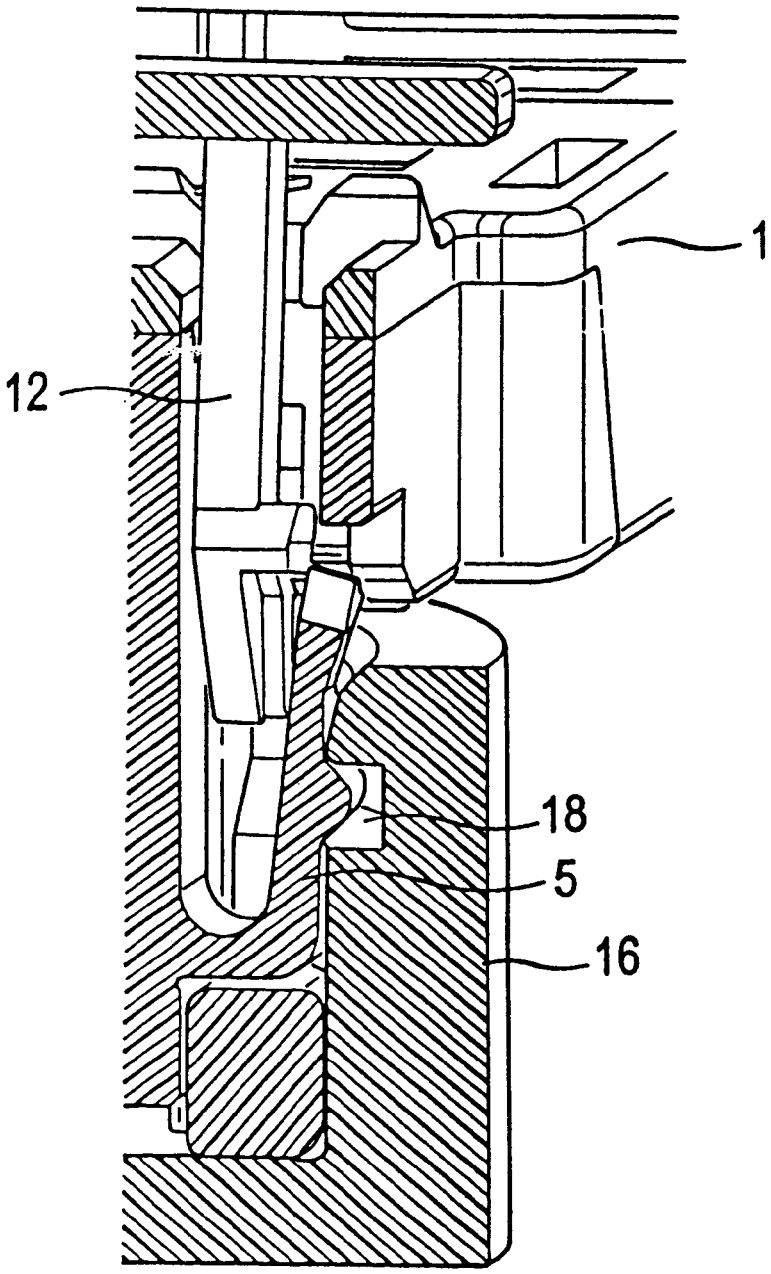
FIG. 5 is a detailed cross-sectional view of the plug connector in the socket after joining.

FIG. 5 is an enlargement showing how the locking shoulders 6 of the locking arms 5 snap into the recesses 18 through the complete insertion of the plug connector 1 into the socket 16, so that the path of the legs 10 is vacated. The secondary locking device can now be pressed into the final locked position in the plug connector 1. During this process, a guiding leg 19 (see FIG. 2) guides the movement of the secondary locking device. During the complete insertion of the secondary locking device, the further leg 11 shown in FIG. 2 releases a short circuit bar (not shown), which short-circuits two contact pins (not shown) of the socket.

Figure 6:
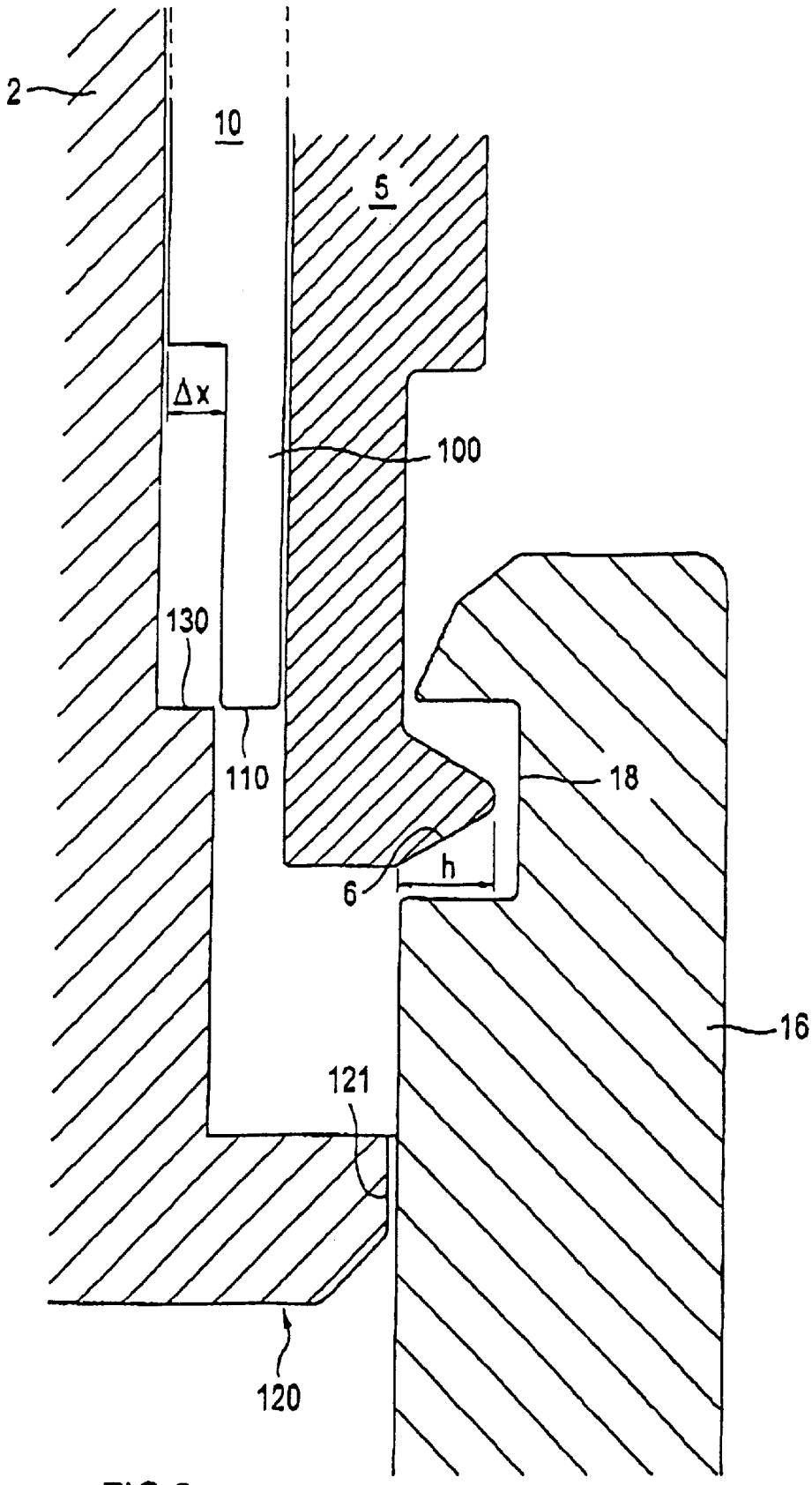
FIG. 6 is a detailed cross-sectional view of a second embodiment.

FIG. 6 shows a detailed cross-section of a second embodiment of the plug connector according to the invention. In this embodiment, the locking arm in substantially parallel with the free end extending from the plug connector housing, on which a locking projection 6 is arranged for locking into a corresponding slot 18 in the socket 16. Into the slit between the plug connector housing 2 and the side of the locking arm 5 directed to the central longitudinal axis, can be inserted a leg 10 of a secondary locking device 8. The second embodiment is characterised by the particular forms of the said leg 10 and the slot. The leg 10 has at its free end 100 on the side opposite the central longitudinal axis of the secondary locking device, in its radial thickness, an offset □x. The radial slot thickness between the plug connector housing 2 and the locking arm 5 is seen unreduced in the direction of insertion of the secondary locking device 8 as far as the height of the top 110 of the leg 10 in pre-locked position. In its continuing course, the radial slot thickness is reduced in size by approximately the amount of the size of the offset as far as the final locking depth of the secondary locking device on the side of the offset. The leg 10 is held in the pre-locked position by the pressure of the step 13 on the locking projection 15 (see FIG. 3). During the process of insertion of the plug connector into the corresponding socket 16, the step is lifted from the locking projection. During a short travel of the insertion process, this creates the possibility of an error, whereby, by pressure on the clamp 9 of the secondary locking device 8, a premature insertion of the secondary locking device becomes possible, without the locking projection 6 already having been locked into the corresponding slot 18 in the socket 16. This makes impossible a normal insertion of the plug connector 1 into the socket 16. In order to prevent this from happening, the thickness reduction of the front end of the leg 10 and the shoulder 130 on the level of the free end 110, causes the locking arm 5 to bend the front end of the leg 10 during the process of insertion, during the sliding of the tip of the locking projection 6 on the upper inner edge of the socket 16, so far in the direction of the central longitudinal axis of the plug connector 1, that the free end 110 of the leg 10 comes to lie opposite the shoulder 130. In this way, it is impossible to displace the secondary locking device 8 into its final locked position during this phase of the process of insertion of the plug connector 1 into the socket 16. Only after the locking projection 6 has become locked into the slot 18 of the socket 16, does the locking arm 5 vacate the slot to the extent of enabling the secondary locking device 8 to be pushed out of the pre-locked position into the final locked position.

In order to facilitate the insertion of the plug connector 1 into the socket 16, the plug connector housing 2 is conical tapered at one insertion end in the direction of insertion and forms in front of the free end of the locking arms, circular segment-shaped aprons (120), opposite the outer edge 121 of which only its locking projections radially extend.

The plug connector according to the invention ensures that with the secondary locking device in the final locked position, the connection between the plug connector and the socket is secure. An insertion of the secondary locking device into the final locked position prevented by means of two supporting points, firstly through the support of the step 13 on the locking projection 15 and secondly by the support of the leg 10 on the face 17 at the rear end of the locking arms 5. Only when both these points of support have been vacated and which only happens when the plug connector 1 has been completely inserted into the socket 16, is the insertion of the secondary locking device 8 possible. An insertion of the plug connector 1 into the socket is possible, either through pressure on the upper face 7 of the housing 2, or through pushing the plug connector 1 into the socket and subsequent pressure on the secondary locking device or only through pressure on the secondary locking device.

What is claimed is:

1. A plug connector having a secondary locking device which includes at least one leg, where the at least one leg fixes a locking arm of the plug connector in a final locked position in a socket, where the at least one leg includes at least one device locking arm comprising two spring arms each with a step which is supported on a locking projection formed on a housing of the plug connector and which holds the secondary locking device in a pre-locked position, and further wherein the secondary locking device can be locked into the final locked position, wherein each of the spring arms has a projection, the spring arms being arranged symmetrically to a longitudinal axis of the plug connector, whereby during insertion of the plug connector into the socket, the spring arms are deflected by the locking projection in such a way such that the step of each spring arm lifts off from the locking projection and the secondary locking device is thereby released.

2. A plug connector according to claim 1, wherein said projection is wedge-shaped and extends to a face of said socket during insertion of said plug connector into said socket.

3. A plug connector according to claim 1, wherein during insertion of said locking device into said plug connector, a free end of said at least one leg is supported on another free end of said locking arm and prevents an insertion of said secondary locking device into said final locked position until said locking arm of the plug connector snaps into a recess which is provided for the purpose to lock said plug connector into said socket, whereby said locking arm of the plug connector allows said at least one leg and said secondary locking device to be locked into final locked position.

4. A plug connector according to claim 1, wherein said locking arm of the plug connector is formed on an insertion face formed on an underside of said housing, and has a free end that is bent towards the direction of insertion of said locking device into said plug connector.

5. A plug connector according to claim 1, wherein said secondary locking device has a further leg whereupon when said secondary locking device is locked into said final locked position, there releases a short-circuit bar and a short-circuit forms between two end contacts of said socket.

6. A plug connector according to claim 1, wherein said at least one leg has an offset □x of its radial thickness at a free end on a side facing the longitudinal axis of said secondary locking device, where a radial slot between said housing and said locking arm of the plug connector in the direction of insertion of said secondary locking device has a first width up to a height of a tip of said at least one leg when the secondary locking device is in the pre-locked position and a reduced width below the tip and up to said final locked position, the reduced width being reduced relative to the first width by offset amount □x.

7. A plug connector according to claim 6, wherein said locking arm of the plug connector has another free end arranged in said direction of insertion of said locking device into said plug connector.

8. A plug connector according to claim 7, wherein said plug connector housing tapers conically at its insertion end and has circular segment-shaped aprons arranged in front of said locking arm of the plug connector, the aprons having at least one outer edge from which only connector locking projections of said locking arm of the plug connector radially project.

9. A plug connector according to claim 8, wherein front edges of said connector locking projections lie so far in a direction of said insertion from a front edge of said step of each spring arm, whereby during insertion of said connector locking projections of the locking arm of the plug connector into a corresponding slot in said socket, said step on at least one of the spring arms is pushed away by said locking projection on said plug connector housing, in order to release said secondary locking device for locking into said final locked position.

10. A plug connector according to claim 6, wherein a radially and internally lying side of a free end of said locking arm of the plug connector, elastically presses a front end of said at least one leg against an inner wall of the slot between said housing and said locking arm of the plug connector during insertion, so that front faces of the at least one leg lie opposite a step formed in the slot, so that until the locking of said locking arm of the plug connector, said secondary locking device is prevented from being pressed into the final locked position.

11. A plug connector having a secondary locking device which includes at least one leg, where the at least one leg fixes a locking arm of the plug connector in a final locked position in a socket, where the at least one leg includes at least one device locking arm comprising two spring arms each with a step which is supported on a locking projection formed on a housing of the plug connector and which holds the secondary locking device in a pre-locked position, and further wherein the secondary locking device can be locked into the final locked position, wherein each of the spring arms has a projection, the spring arms being arranged symmetrically to a longitudinal axis of the plug connector, whereby during insertion of the plug connector into the socket, the spring arms are deflected by the locking projection in such a way whereby the step of each spring arm lifts off from the locking projection and the secondary locking device is thereby released, and further wherein during insertion of the locking device into the plug connector, a free end of the at least one leg is supported on another free end of the locking arm of the plug connector and prevents insertion of the secondary locking device into the final locked position, until the locking arm of the plug connector snaps into a recess which is provided for the purpose to lock the plug connector into the socket, whereby the locking arm of the plug connector allows the at least one leg of the secondary locking device to be locked into its final locked position.

12. A plug connector having a secondary locking device which includes at least one leg, where the at least one leg fixes a locking arm of the plug connector in a final locked position in a socket, where the at least one leg includes at least one device locking arm comprising two spring arms each with a step which is supported on a locking projection formed on a housing of the plug connector and which holds the secondary locking device in a pre-locked position, and further wherein the secondary locking device can be locked into the final locked position, wherein each of the spring arm has a projection, the spring arms being arranged symmetrically to a longitudinal axis of the plug connector, whereby during insertion of the plug connector into the socket, the spring arms are deflected by the locking projection in such a way such that the step of each spring arm lifts off from the locking projection and the secondary locking device is thereby released, the locking arm of the plug connector being formed on an insertion face formed on the underside of the housing, where a free end of the locking arm of the plug connector is bent towards the direction of insertion of the locking device into the plug connector, and the secondary locking device having a further leg whereupon when the secondary locking device is locked into the final locked position, there releases a short-circuit bar and a short-circuit forms between two end contacts of the socket.

13. A plug connector assembly comprising:

a plug connector having a plug connector housing with resiliently flexible locking arms for locking the plug connector into a socket, the plug connector housing having a first locking projection depending therefrom; and a secondary locking device movably connected to the plug connector housing, the secondary locking device being movable relative to the plug connector housing from a pre-locked position to a locked position, the second locking device having a frame with at least one locking leg for locking the plug connector in the socket, and at least one resiliently flexible arm, the resiliently flexible arm having a step formed therein disposed to seat against the first locking projection for holding the secondary locking device in the pre-locked position;

wherein, during insertion of the plug connector into the socket the resiliently flexible arm is resiliently deflected so that the step is unseated from the first locking projection releasing the secondary locking device from the pre-locked position, and at least one of the locking arms of the plug connector housing is resiliently deflected so that a seating surface on the at least one locking arm is disposed to abut against a mating surface of the locking leg preventing the second locking device from moving into the locking position.

14. The plug connector according to claim 13, wherein the at least one resiliently flexible arm is resiliently deflected by the first locking projection, the deflection of the at least one resiliently flexible arm by the first locking projection causing the step to lift off from the first locking projection unseating the step from the first locking projection.

15. The plug connector according to claim 13, wherein at least one of the resiliently flexible locking arms has a detent for engaging the socket when the plug connector is located in the socket, and has a second locking projection for locking the at least one resiliently flexible arm of the secondary locking device.

16. The plug connector according to claim 15, wherein the second locking projection is disposed substantially opposite the first locking projection trapping the step on the at least one resiliently flexible arm between the first and second locking projections.

17. The plug connector according to claim 16, wherein the first locking projection resiliently deflects the at least one resiliently flexible arm when the second locking projection is moved to release the step of the at least one resiliently flexible arm.

18. The plug connector according to claim 17, wherein when the detent enters a mating slot in the socket, the at least one resiliently flexible locking arm springs back from a deflected position moving the second locking projection to release the step of the at least one resiliently flexible arm.

* * * * *